US012662278B2

(12) United States Patent
Bertolani et al.

(10) Patent No.: US 12,662,278 B2
(45) Date of Patent: Jun. 23, 2026

(54) METHOD AND PLANT FOR MANUFACTURING A SECONDARY PACKAGING ACCORDING TO THE BOD LOGIC

(71) Applicant: Voidless S.r.l., Milan (IT)

(72) Inventors: Mattia Bertolani, Milan (IT); Carlo Villani, Milan (IT); Daniel Kaidanovic, Milan (IT); Guglielmo Franco Riva, Milan (IT)

(73) Assignee: Voidless S.r.l., Milano Mi (IT)

( * ) Notice: Subject to any disclaimer, the term of this patent is extended or adjusted under 35 U.S.C. 154(b) by 0 days.

(21) Appl. No.: 18/870,097

(22) PCT Filed: May 29, 2023

(86) PCT No.: PCT/IB2023/055483
§ 371 (c)(1),
(2) Date: Nov. 27, 2024

(87) PCT Pub. No.: WO2023/233267
PCT Pub. Date: Dec. 7, 2023

(65) Prior Publication Data

US 2025/0368372 A1 Dec. 4, 2025

(30) Foreign Application Priority Data

May 31, 2022 (IT) ..... 102022000011477

(51) Int. Cl.
*B65B 57/12* (2006.01)
*B65B 5/02* (2006.01)
(Continued)

(52) U.S. Cl.
CPC ..... *B65B 57/12* (2013.01); *B65B 5/024* (2013.01); *B65B 35/30* (2013.01); *B65B 43/10* (2013.01);
(Continued)

(58) Field of Classification Search
CPC ..... B65B 57/12; B65B 5/024; B65B 35/30; B65B 43/10; B65B 65/003; B65B 2210/04; B65B 2220/16
See application file for complete search history.

(56) References Cited

U.S. PATENT DOCUMENTS 10,940,965 B2 * 3/2021 Sytema ..... B65D 25/06
11,661,227 B2 * 5/2023 Benterman ..... B26D 1/305 493/309

(Continued)

FOREIGN PATENT DOCUMENTS

WO WO2014117817 8/2014
WO WO2019081773 5/2019

OTHER PUBLICATIONS

Search report and written opinion dated Oct. 13, 2023; International Application No. PCT/IB2023/055483; 11 pages.

*Primary Examiner* — Himchan Song
(74) *Attorney, Agent, or Firm* — Rankin Hill & Clark, LLP; Erik J. Overberger

(57) ABSTRACT

The disclosure concerns a method for manufacturing a secondary packaging according to the BOD logic. The method in particular envisages managing a plurality of orders, each comprising a plurality of items. For each item, it is defined the primary cuboid circumscribed to it and for each order, it is identified the most compact arrangement of the items and the secondary cuboid circumscribed to it. The blanks representing the plane developments of the boxes that contain the secondary cuboids are then defined. After having optimized the arrangement thereof, the blanks are cut out of a sheet of packaging material. The boxes are thus assembled with the blanks and are each filled with their own order in the most compact arrangement. The disclosure further concerns a plant applying the method.

15 Claims, 8 Drawing Sheets

(51) Int. Cl.
*B65B 35/30* (2006.01)
*B65B 43/10* (2006.01)
*B65B 65/00* (2006.01)

(52) U.S. Cl.
CPC ..... *B65B 65/003* (2013.01); *B65B 2210/04* (2013.01); *B65B 2220/16* (2013.01)

(56) References Cited

U.S. PATENT DOCUMENTS

| | | | | |
|---|---|---|---|---|
| 2008/0121537 | A1* | 5/2008 | Sankaran | B65B 43/267 206/223 |
| 2013/0000252 | A1* | 1/2013 | Pettersson | B65B 5/024 348/46 |
| 2017/0210500 | A1* | 7/2017 | Sytema | B65B 11/004 |
| 2017/0217620 | A1* | 8/2017 | Zeilstra | B65B 43/08 |
| 2018/0086486 | A1* | 3/2018 | Campbell | B65B 9/026 |
| 2018/0134421 | A1* | 5/2018 | Ponti | B65B 43/10 |
| 2018/0215485 | A1* | 8/2018 | Koet | B65B 5/12 |
| 2020/0039668 | A1* | 2/2020 | Que | B65B 5/12 |
| 2020/0198823 | A1* | 6/2020 | Bauer | B65B 43/145 |
| 2022/0083943 | A1* | 3/2022 | He | G06Q 10/06313 |

* cited by examiner

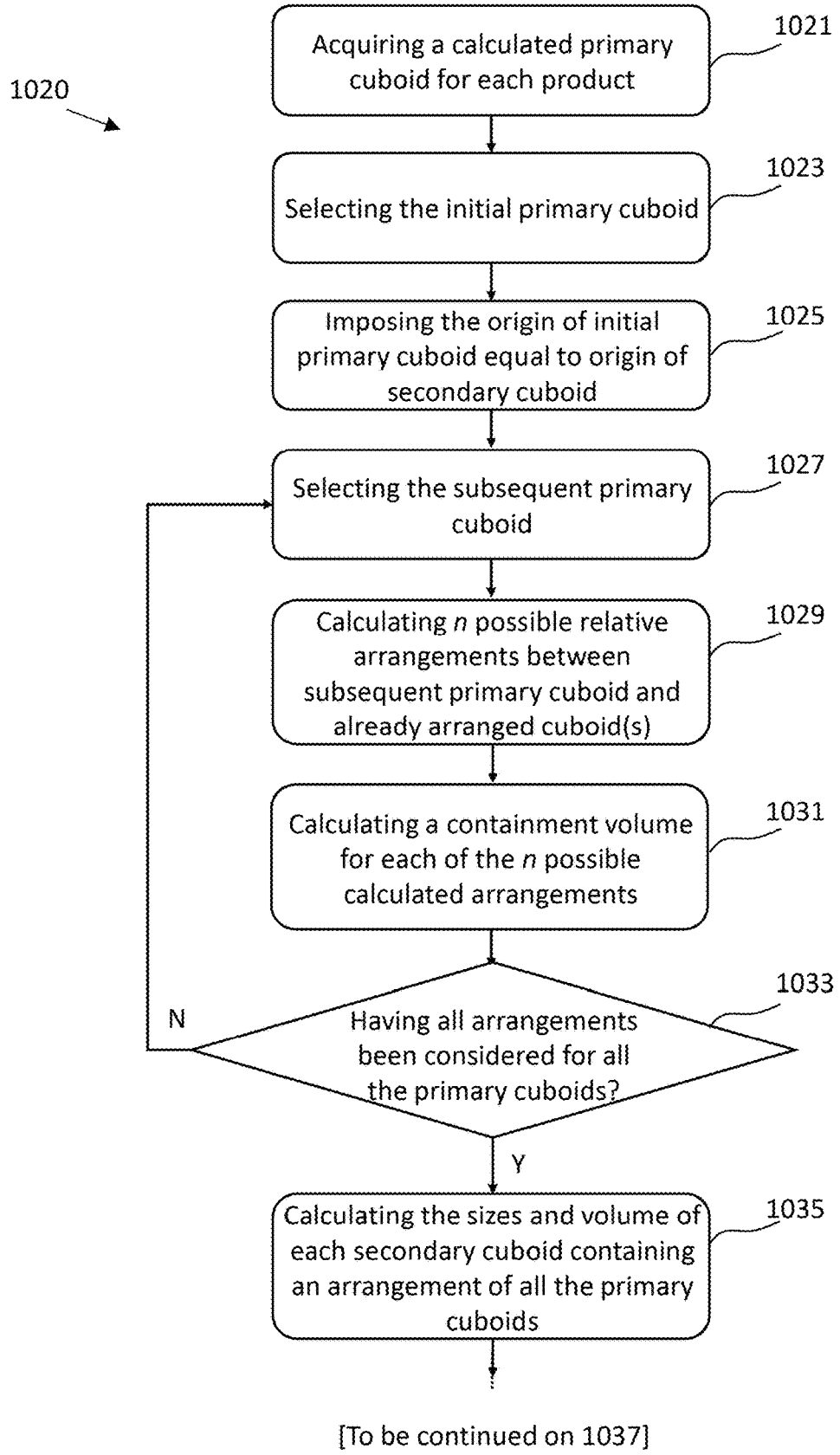
[To be continued on 1037]
Fig. 2.a

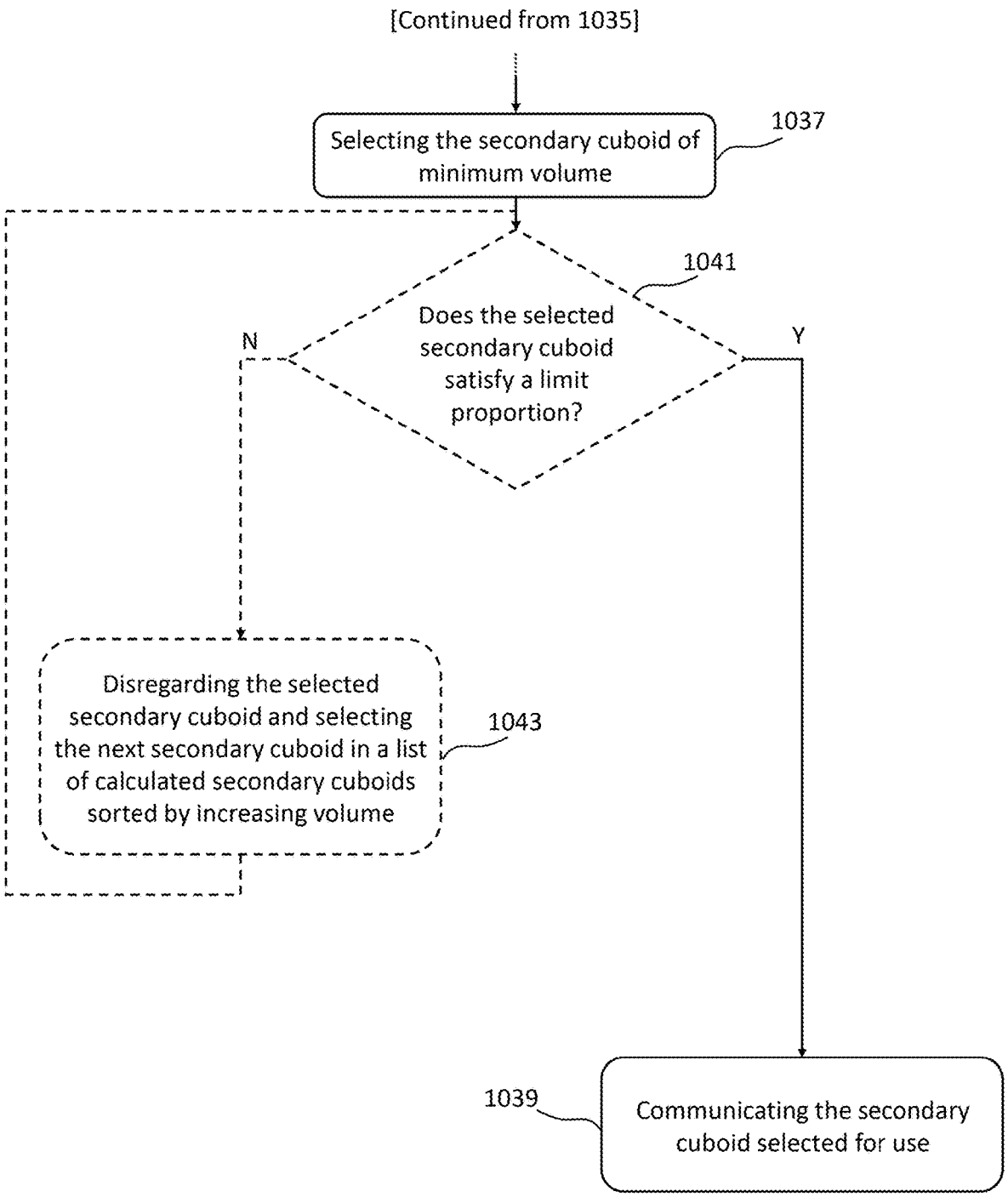
Fig. 2.b

METHOD AND PLANT FOR MANUFACTURING A SECONDARY PACKAGING ACCORDING TO THE BOD LOGIC

TECHNICAL FIELD

The present disclosure refers to the sector of the secondary packagings, and in particular to the secondary packagings made according to the logic called BOD (Box On Demand).

BACKGROUND

In the field of goods distribution, providing secondary packagings aimed at simplifying the handling and the shipment of the goods themselves is known.

Each item is usually sold on the market enclosed within its own packaging, called primary, made directly by the manufacturer. The primary packagings are usually studied and manufactured by the manufacturers with the aim of presenting their products in the most appropriate way. In fact, the manufacturer often uses the primary packaging as a communication tool to transmit, through the choice of materials, finishes and graphics, the qualities that he wishes to associate with his product contained in its inside.

Conversely, the secondary packaging is usually provided by a subject other than the manufacturer, such as a distributor, a retailer or a shipper. The secondary packaging contains in its inside one or more products, often unrelated to each other, each complete with its own primary packaging. The secondary packaging is therefore intended to accompany the products only in the steps of handling and shipping the goods and therefore has a purely practical function. The secondary packaging must protect the products in its inside (including the primary packagings thereof) and must be suitable for showing the indications useful for handling and/or shipping. For this reason the secondary packaging is usually made of simple corrugated cardboard. Once the products are delivered, the secondary packaging ends its function and is disposed of.

With the recent growth of the electronic market, where the products are ordered by the consumers on specific on-line platforms and are thus grouped, repackaged and shipped by the seller, the secondary packagings have become increasingly important.

In the sector of the secondary packagings, different approaches are possible on the part of the seller who ships the products, usually collected into groups according to the customer's orders. For example, a single order may contain a mobile phone with some accessories, such as a power reserve, headphones or a case, but it may also contain completely different objects such as a book, a household item or the like.

A first approach is to provide for the seller to use predefined boxes based on a finite number of measurements and proportions. This type of approach therefore envisages arranging each group of products in the box which, among those capable of containing the entire group, has the smallest volume. The general rule is in fact that the cost for shipping a package depends on its weight and on its volume. Once the order defines the products, the total weight of the package is defined, too, net of the weight of the secondary packaging. However, since the differences in weight between the different boxes available are considered as negligible, in order to minimize the shipping costs it is preferable to minimize the volume of the package.

This method of providing the secondary packaging through predefined boxes can be carried out manually or automatically. As the skilled person can well understand, when the method is applied manually, the result of the execution depends to a large extent on the experience and care of the operator. In general, the manual method allows to safely handle all types of products, including the fragile, perishable or potentially dangerous ones. On the other hand, it requires relatively long processing times and implies a rather high probability of error in the optimization of the volume of the box. In fact, the operator, especially in the face of a large workload, can be led to choosing a slightly larger box than strictly necessary if this allows to speed up the operation. Conversely, the automatic execution of this operation, while improving the optimization step, does not allow the management of fragile, perishable or potentially dangerous items. To assess the impact of this limitation on the automatic application of the method, consider for example that all the batteries commonly used in the portable electronic devices are considered as potentially dangerous because they are flammable, and therefore cannot be managed automatically.

This type of approach that envisages using a finite number of types of boxes implies in any case, be it manual or automatic, the use of a sub-optimal solution, because rarely a predefined box will be able to be completely filled by the group of products that constitute the order. It is much more likely that an empty portion of volume remains inside each box which portion must be filled with some filling material. This represents a significant disadvantage for several reasons. Firstly, due to the shipping cost which, being linked to the volume of the box, is greater than strictly necessary. In addition, the systematic shipping of enlarged boxes with respect to the actual needs implies a greater number of journeys of the freight carrier, be it an airplane, a ship or a van. Finally, there is a problem of consumer satisfaction. Upon receiving a partially empty box filled with filling material, the consumer perceives the shipment as inefficient and with an environmental impact greater than necessary.

A different approach, which tries to solve the drawbacks described above, is that of the so-called BOD (from Box On Demand) which provides for the manufacture of a specific box for each group of objects, or order, being shipped by the seller. In other words, once the group of products to be shipped is defined for a single order, the relative box is built on the spot with ad hoc measurements, thus managing to optimize the volume of the box much more efficiently than the method described above. The BOD approach, much more sophisticated, requires today the use of very complex and expensive plants that create and provide the secondary packaging in a fully automatic way. After an operator has arranged the products of the order, the plant detects their measurements, cuts the box out of a sheet of cardboard and builds the box around the products. This solution guarantees a high speed of execution but, in addition to the high initial cost, like all the fully automatic processes, does not allow to manage fragile, perishable or potentially dangerous items. Furthermore, by using a fixed amount of cardboard for each box (e.g. a sheet), regardless of the sizes, this method implies a large waste of cardboard.

OBJECTS AND SUMMARY OF THE DISCLOSURE

Aim of the present disclosure is therefore that of at least partially overcoming the drawbacks highlighted above in relation to the prior art.

In particular, a task of the present disclosure is to provide a method and a plant for manufacturing a secondary packaging according to the BOD logic, which can handle all types of items, including the fragile, perishable or potentially dangerous ones.

Furthermore, a task of the present disclosure is to provide a method and a plant for manufacturing secondary packagings according to the BOD logic, particularly efficient in terms of volume of the boxes produced and consumption of packaging material.

Moreover, a task of the present disclosure is to provide a method and a plant for manufacturing secondary packagings according to the BOD logic, which are very efficient in terms of ratio between costs and performance.

Finally, a task of the present disclosure is to provide a method and a plant for manufacturing secondary packagings according to the BOD logic that, together with the advantages introduced, maintain as much as possible the functionalities of the prior art.

These and other objects and tasks of the present disclosure are achieved by a method and plant in accordance with the appended claims. Further characteristics are identified in the dependent claims. All appended claims form an integral part of the present disclosure.

In accordance with a first aspect, the disclosure concerns a method for manufacturing a secondary packaging according to the Box On Demand logic. The method of the disclosure comprises the steps of:

providing a plurality N of orders o, each order $o_i$ comprising a plurality of items $a_{ij}$;

for each item $a_{ij}$ of each order $o_i$, defining the primary cuboid circumscribed to the item $a_{ij}$;

for each order $o_i$, identifying the relative arrangement of the items $a_{ij}$ that is the most compact;

for each order $o_i$, detecting the sizes of the secondary cuboid circumscribed to the most compact arrangement;

arranging each order $o_i$ in a standby storage;

for each secondary cuboid defining the blank representing the plane development of the box which defines an inner volume equal to the secondary cuboid;

adding each blank in a standby list;

providing a sheet of packaging material of predefined sizes;

optimizing the arrangement on the sheet of at least some of the blanks in the standby list, so as to minimize the waste of packaging material;

cutting the blanks in the sheet;

deleting the cut blanks from the standby list;

taking a blank from the sheet;

assembling the box with the taken blank;

taking from the standby storage the order $a_i$ corresponding to the assembled box;

arranging the items $a_{ij}$ in the box according to the most compact arrangement;

providing the box for the subsequent steps;

repeating the steps of: taking a blank, assembling the box, taking the corresponding order, arranging the items in the box, providing the box for the subsequent steps, up to the end of the cut blanks;

discarding the waste of packaging material; and repeating the method up to the end of the orders.

The method of the disclosure makes it possible to optimize the manufacture of the secondary packaging, minimizing waste.

Preferably, the step of identifying for each order $o_i$ the relative arrangement of the items $a_{ij}$ that is the most compact is carried out by means of a recursive optimization algorithm considering all the possible relative arrangements of the items $a_{ij}$, modifying step by step the positioning of each primary cuboid with respect to the other primary cuboids, calculating the sizes of all the secondary cuboids and selecting the most compact arrangement.

The optimization algorithm allows to quickly and efficiently obtain the most compact arrangement of the items and therefore to minimize waste in the manufacture of the secondary packaging.

Preferably the recursive optimization algorithm implements the steps of:

defining each item $a_{ij}$ by means of the respective primary cuboid having three measurements: $x_j$, $y_j$ and $z_j$, for each primary cuboid, identifying the measurements $x_j$, $y_j$ and $z_j$ starting from a point called origin [0; 0; 0] which is positioned in a vertex of the cuboid, in each primary cuboid, identifying three available vertices, corresponding to the vertices in the positions [$x_j$; 0; 0], [0; $y_j$; 0] and [0; 0; $z_j$] with respect to the origin, during the positioning step, arranging the origin of a new primary cuboid so as to coincide with an available vertex of one of the primary cuboids already positioned, and when the origin of a primary cuboid is positioned on an available vertex, discarding the cuboid from a list of primary cuboids to be arranged such that said primary cuboid is no more available for the subsequent positionings.

Preferably, the optimization algorithm further envisages carrying out the steps of:

storing the volume and the sizes of each calculated secondary cuboid, verifying whether the secondary cuboid corresponding to the most compact arrangement of the items has a shape ratio between at least two sizes comprised in a tolerance range, in the positive, using said secondary cuboid, or in the negative, disregarding said secondary cuboid and selecting a further cuboid associated to the most compact arrangement once excluded the arrangement associated to the disregarded secondary cuboid and repeating the preceding step of verifying the secondary cuboid.

This algorithm is particularly efficient in optimizing the arrangement of the items a of each order o.

Preferably, the optimization algorithm further carries out the step of adding an offset value to at least one of the sizes of at least one of the items to be arranged, said offset value corresponding to a gap necessary for placing a protection material for protecting the item, during the filling of the packaging.

The addition of offset values allows to also introduce protection material easily into the packaging, increasing the safety of the packaging.

Preferably, the method, further comprises a step of printing between the step of optimizing and the step of cutting the blanks.

The printing step allows to obtain a higher quality of the packaging, in terms of convenience for the operators and/or of quality perceived by the recipient.

Preferably, the method further comprises a step of creasing between the step of optimizing and the step of cutting the blanks.

The creasing step makes the subsequent folding step easier and more precise.

In accordance with a second aspect, the disclosure concerns a plant for manufacturing a secondary packaging according to the Box On Demand logic. The plant of the disclosure comprises:

an electronic unit comprising a memory module, an elaboration module, and control modules configured for providing instructions to the plant;

a general storage comprising a plurality of items a;

handling members configured for, on the basis of the instructions provided by the electronic unit:

taking items a from the general storage; and grouping together the taken items a so as to constitute a plurality of orders o, a standby storage configured for maintaining the orders in standby o; and feeding members configured for making available a sheet of packaging material of predefined sizes, on the basis of the instructions provided by the electronic unit.

The electronic unit is further configured for: defining the blank of the box relative to each order $o_i$, adding each blank to a standby list; optimizing the arrangement on the sheet of some of the blanks in the standby list; and deleting the cut blanks from the standby list.

The Plant Also Comprises:

a cutting station configured for cutting out of the sheet the blank of a box on the basis of the instructions provided by the electronic unit, wherein the blank is defined by the electronic unit in relation to a specific order $o_i$;

a pre-assembly station configured for pre-assembling the box starting from the cut blank;

a packaging station; and movement members configured for, on the basis of the instructions provided by the electronic unit, making available to the packaging station the pre-assembled box together with the related order $o_i$.

The plant of the disclosure allows to easily and precisely realize the method of the disclosure.

Preferably, the electronic unit is further configured for: defining a primary cuboid circumscribed to each item $a_{ij}$; identifying the relative arrangement of the items $a_{ij}$ that is the most compact for each order $o_i$; detecting the sizes of a secondary cuboid circumscribed to the most compact arrangement; for each secondary cuboid defining the blank of the relative box.

Preferably, the plant further comprises a printing station placed between the feeding members of the sheet of packaging material and the cutting station.

Preferably, the plant comprises a station for overturning the sheet.

Preferably, the plant further comprises a three-dimensional scanning device, configured for detecting the sizes of an item $a_{ij}$.

In accordance with some embodiments, the cutting station comprises a numerically controlled machine carrying out the cut by means of a laser.

In accordance with other embodiments, the cutting station comprises a numerically controlled machine carrying out the cut by means of a blade, preferably an oscillating blade.

Preferably the plant further comprises a robotic arm suitable for taking cut blanks from the cutting station and for feeding them to the pre-assembly station.

Preferably the Pre-Assembly Station Comprises:

a worktable having a width and a length, wherein the worktable is configured for receiving and supporting a blank with a predetermined orientation;

two folding elements, movable in the direction w of the width of the worktable; and pushing members configured for pushing the blank toward the folding elements and beyond, in the direction l of the length of the worktable.

Each of the folding elements comprises a helical screw surface developing around a longitudinal axis b, parallel to the direction l.

Further features and purposes of the present disclosure will become more evident from the description below.

BRIEF DESCRIPTION OF THE DRAWINGS

The invention will be described below with reference to some examples, provided for explanatory and non-limiting purposes, and illustrated in the annexed drawings. These drawings illustrate different aspects and embodiments of the present invention and reference numerals illustrating structures, components, materials and/or similar elements in different drawings are indicated by similar reference numerals, where appropriate. Moreover, for clarity of illustration, certain references may not be repeated in all drawings.

FIGS. 2.*a* and 2.*b* represent a block diagram of a three-dimensional optimization algorithm preferably used in a step of the method;

DETAILED DESCRIPTION OF THE INVENTION

Figure 1:
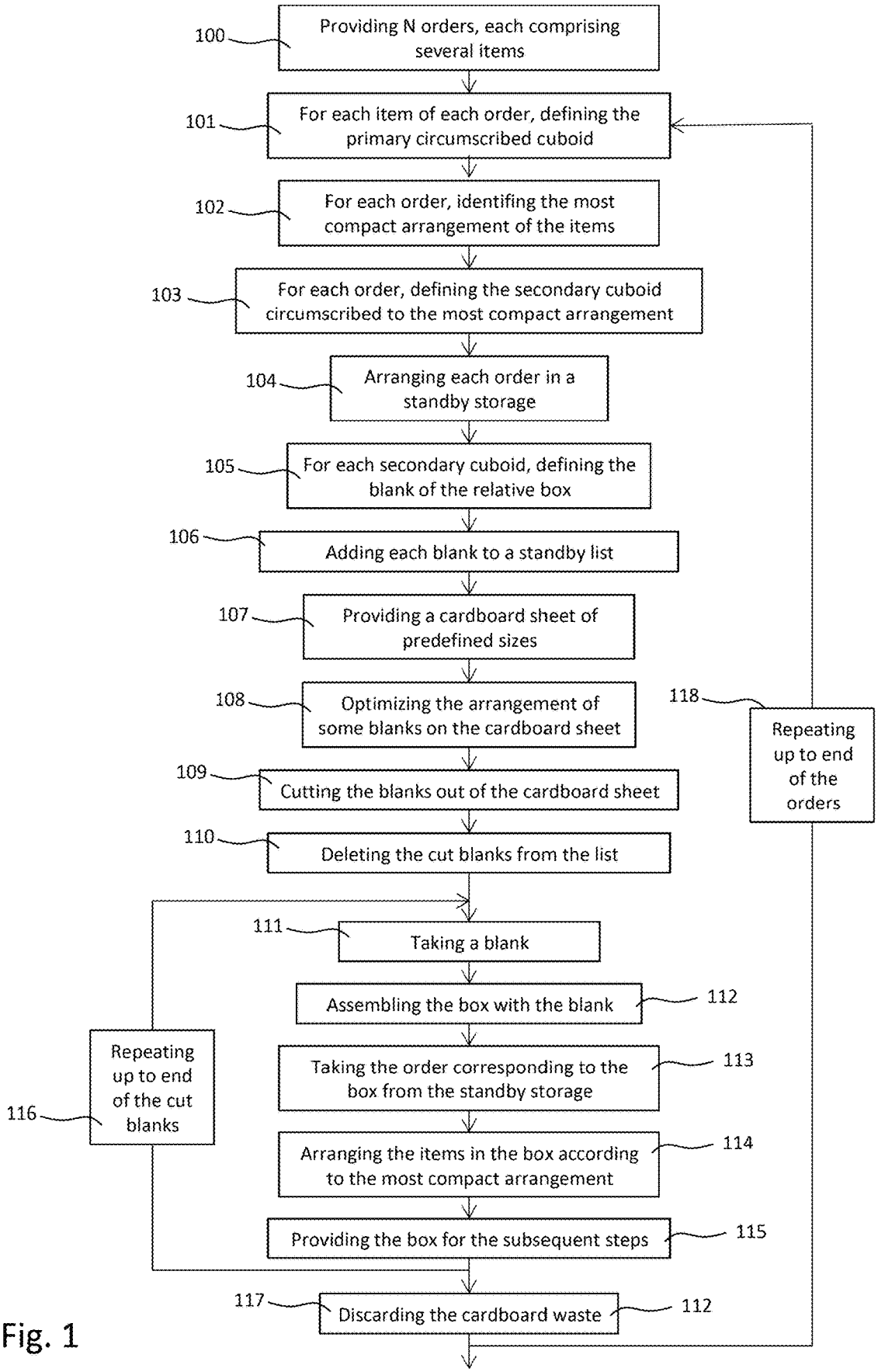
FIG. 1 represents a block diagram of the method of the disclosure.

While the invention is susceptible to various modifications and alternative constructions, certain preferred embodiments are shown in the drawings and are described hereinbelow in detail. It must in any case be understood that there is no intention to limit the invention to the specific embodiment illustrated, but, on the contrary, the invention intends covering all the modifications, alternative and equivalent constructions that fall within the scope of the invention as defined in the claims.

The description deals in detail with the peculiar aspects and the technical characteristics of the invention, while the aspects and the technical characteristics per se known can only be hinted at. In these respects, what is reported above with reference to the prior art remains valid.

The use of "for example", "etc.", "or" indicates non-exclusive alternatives without limitation, unless otherwise indicated. The use of "comprises" and "includes" means "comprises or includes, but not limited to", unless otherwise indicated.

The method and the plant of the disclosure are intended to manage a plurality of orders o, wherein each order comprises a plurality of items a. In the following discussion, indices are sometimes used to indicate a specific element: a possible first index identifies the order and a possible second index identifies the item within the order. For example, to indicate, in the plurality of orders, a specific order o, use is made of the index i in the notation $o_i$. Similarly, to indicate, in the plurality of items that are part of the order $o_i$, a specific item a use is made of the index i that indicates the order and the index j that indicates the item, in the notation $a_{ij}$.

In accordance with a first aspect, the disclosure concerns a method for manufacturing a secondary packaging according to the BOD logic (Box On Demand). The method of the disclosure comprises the steps of:

- providing a plurality N of orders o, each order o comprising a plurality of items $a_{ij}$ (block 100);
- for each item $a_{ij}$ of each order $o_i$, defining the primary cuboid circumscribed to the item $a_{ij}$ (block 101);
- for each order $o_i$, identifying the relative arrangement of the items $a_{ij}$ that is the most compact (block 102);
- for each order $o_i$, detecting the sizes of the secondary cuboid circumscribed to the most compact arrangement (block 103);
- arranging each order $o_i$ in a standby storage 56 (block 104);
- for each secondary cuboid defining the blank $\mathbf{64}_i$ representing the plane development of the box 66 which defines an inner volume equal to the secondary cuboid (block 105);
- adding each blank $\mathbf{64}_i$ in a standby list (block 106);
- providing a sheet 60 of packaging material of predefined sizes (block 107);
- optimizing the arrangement on the sheet 60 of at least some of the blanks 64 in the standby list, so as to minimize the waste of packaging material (block 108);
- cutting the blanks 64 in the sheet 60 (block 109);
- deleting the cut blanks 64 from the standby list (block 110);
- taking a blank $\mathbf{64}_i$ from the sheet 60 (block 111);
- assembling the box $\mathbf{66}_i$ with the taken blank $\mathbf{64}_i$ (block 112);
- taking from the standby storage 56 the order $o_i$ corresponding to the assembled box $\mathbf{66}_i$ (block 113);
- arranging the items in the box $\mathbf{66}_i$ according to the most compact arrangement (block 114);
- providing the box $\mathbf{66}_i$ for the subsequent steps (block 115);
- repeating the steps of: taking a blank 64, assembling the box 66, taking the corresponding order, arranging the items in the box 66, providing the box 66 for the subsequent steps, up to the end of the cut blanks 64 (block 116);
- discarding the waste of packaging material (block 117); and
- repeating the method up to the end of the orders (block 118).

As the skilled person can well understand, the method of the disclosure is intended to be used in a context in which a plurality of N orders o comes almost continuously from an upstream general storage 54. Preferably, each order $o_i$ is constituted in the upstream storage by gradually depositing in a single container 72 all the items $a_i$ that are part of it. Such a container 72 is uniquely identified, in a manner known per se, by technologies based on automatic recognition, for example by optical codes (such as barcodes, QR codes or the like) or by short-range signals (such as RFID, NFC or the like). In this way, the plant 50 is able to constantly follow the single order $o_i$ in the respective container $\mathbf{72}_i$.

The step (block 101) of defining the primary cuboid circumscribed to each item $a_{ij}$, i.e. the minimum volume cuboid that entirely contains the item $a_{ij}$, can be carried out in different ways. In some cases the item $a_{ij}$ actually has the shape of a cuboid, while in other cases it may have different shapes. In any case, any shape can be inscribed in a primary cuboid having walls tangent to the actual shape. This primary cuboid will be considered in the subsequent steps of the method. In the following discussion, each individual item will be represented by its own primary cuboid, which is why one can refer indifferently to one or the other, even using the same references $a_{ij}$.

In some cases the sizes of the item $a_{ij}$ are already known, for example because they were made available by the manufacturer or because an identical item has already been processed previously under the same method. However, if the sizes of an item $a_{ij}$ are not available, it is possible to detect them on the spot, for example by using a three-dimensional scan. Preferably, this scanning takes place continuously, for example while the item $a_{ij}$ with unknown sizes slides on a conveyor belt.

Also the step (block 102) of identifying for each order $o_i$ the relative arrangement of the items $a_i$ that is the most compact can also be carried out in different ways. In principle, it is possible for an operator to make attempts to position the items of the order with respect to one another in order to obtain the most compact arrangement. However, in accordance with a preferred embodiment, this step of the method is carried out automatically to make it faster and to improve the optimization of the results. For this purpose, three-dimensional optimization algorithms (hereinafter also referred to as 3D algorithms), for example commercially available, can be used. A recursive 3D algorithm of the type described below is particularly advantageous for the purposes of the present disclosure.

The 3D algorithm operates on the n items $a_{i1}, a_{i2} \ldots a_{in}$ of each individual order $o_i$. The 3D algorithm receives in input the sizes of each individual primary cuboid defined in the previous step and supplies in output the sizes of the secondary cuboid (representing the desired box $\mathbf{66}_i$) that encloses all the primary cuboids (representing the items $a_{ij}$ of the order $o_i$) in the most compact arrangement possible.

The 3D algorithm considers all the possible relative arrangements of the items, modifying step by step the positioning of each primary cuboid with respect to the other primary cuboids, calculating the sizes of all the secondary cuboids and selecting the most compact arrangement. In one embodiment, such 3D algorithm 1020 comprises the following steps described in relation to the flowchart of FIG. 2.

For each item $a_{ij}$ of the same order $o_i$ the corresponding primary cuboid calculated in step 101 is acquired (step 1021).

In the example considered, each primary cuboid is defined by 3 measurements: $x_j$ (width), $y_j$ (depth) and $z_j$ (height). The measurements $x_j$, $y_j$ and $z_j$ are identified starting from a point called origin [0; 0; 0] corresponding to a first vertex of the primary cuboid.

The largest size among the three sizes defining each primary cuboid is always selected as a measurement of width $x_j$, while the smallest size among the three sizes defining each primary cuboid is always selected as a measurement of height $z_j$.

The origin of the item $a_{ij}$ is defined such that the triad $x_i$, $y_i$, $z_i$ defined above (width, depth, height) is a right-handed triad.

In addition, for each primary cuboid, 3 available or free vertices are identified, identified with the vertices in the positions [$x_j$; 0; 0], [0; $y_j$; 0] and [0; 0; $z_j$] with respect to the origin.

The 3D algorithm 1020 envisages selecting (step 1023) an initial primary cuboid having larger-sized surfaces among the cuboids associated with the items $a_{ij}$ of the same order o. In detail, the primary cuboid is selected in which the product of the width $x_j$ for the depth $y_j$ is greater than the same product of the remaining primary cuboids associated with the items $a_{ij}$ of the same order $o_i$.

Figure 3:
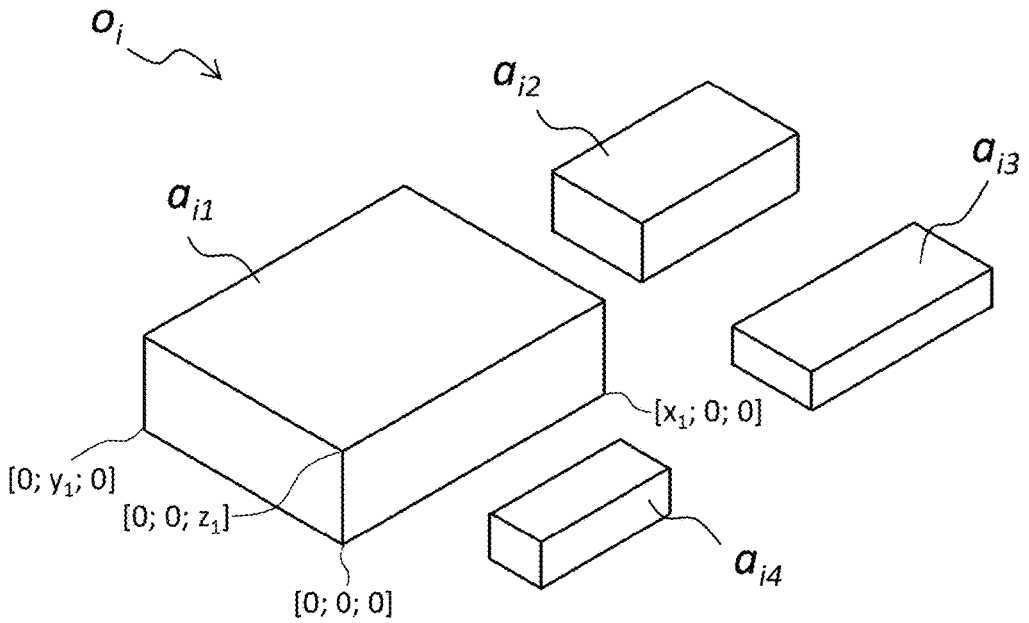
FIG. 3 schematically represents an order comprising a plurality of items.

The example in FIG. 3 schematically represents four primary cuboids representing the four items $a_{i1}$, $a_{i2}$, $a_{i3}$ and $a_{i4}$ that constitute the single order $o_i$. For greater simplicity, in FIG. 3 the origin and the available vertices have been explicitly indicated only for the item $a_{i1}$. The 3D algorithm starts by considering the largest cuboid as the first among those included in the order. For the purposes of this discussion, the initial primary cuboid is the primary cuboid associated with the item $a_{i1}$.

Once the largest primary cuboid has been identified, the algorithm generates all the possible successions of the items of the order, keeping the one corresponding to the largest cuboid as the first item.

For example, again with reference to FIG. 3, once the one associated with the item $a_{i1}$ is identified as the largest cuboid, the algorithm 1020 generates all the possible successions of the 4 items while keeping an as the first element: [$a_{i1}$; $a_{i2}$; $a_{i3}$; $a_{i4}$], [$a_{i1}$; $a_{i2}$; $a_{i4}$; $a_{i3}$], [$a_{i1}$; $a_{i3}$; $a_{i4}$; $a_{i2}$], [$a_{i1}$; $a_{i3}$; $a_{i2}$; $a_{i4}$], [$a_{i1}$; $a_{i4}$; $a_{i2}$; $a_{i3}$] e [$a_{i1}$; $a_{i4}$; $a_{i3}$; $a_{i2}$].

The point of origin $[0; 0; 0]_1$ of the selected primary cuboid is set (step 1025) corresponding to a point of origin of the secondary cuboid to be determined. This step substantially corresponds to a positioning of the initial primary cuboid within the secondary cuboid.

Subsequently, a next primary cuboid associated with one of the remaining items $a_{ij}$ of the same order $o_i$ is selected (step 1027). Preferably, the next primary cuboid, associated with the item $a_{i2}$ in the example of FIG. 3, having surfaces with the largest sizes among the primary cuboids associated with the items $a_{ij}$ of the same order $o_i$ excluding the initial primary cuboid is selected.

The 3D algorithm 1020 envisages calculating (step 1029) the n possible positionings of the next primary cuboid such that the origin $[0, 0, 0]_2$ of the next primary cuboid coincides with one of the available vertices [$x_1$; 0; 0], [0; $y_1$; 0] and [0; 0; $z_1$] of the initial primary cuboid.

In an alternative embodiment, an offset value is defined, i.e. a gap to be left between the various items inside the box. For example, the offset value may be added to each size of one or more of the items $a_{ij}$ of the same order $o_i$. These gaps are then filled with filling and protection material during the step of packaging the items.

Additionally or alternatively, the calculated positionings are a subset of the n possible positionings. In particular, one or more of the items $a_{ij}$ may be associated with prohibited positionings or, alternatively, with permitted positionings. In this way, it is possible to prevent an item $a_{ij}$ from being positioned inside the box in such a way as to compromise or damage the item $a_{ij}$.

A partial containment volume is then calculated (step 1031) for each of the n positionings. Each partial containment volume corresponds to the volume of a parallelepiped which comprises the initial primary cuboid and the next primary cuboid which are positioned according to the corresponding n-th positioning.

The 3D algorithm 1020 then repeats steps 1027-1031 until the primary cuboids associated with the items $a_{ij}$ of the same order o have been considered (decision step 1033). In other words, the algorithm 1020 considers all possible arrangements, considering in a recursive manner any possible mutually positioning permutation of the primary cuboids, starting from the cuboid with the largest sizes. In practice, once the largest cuboid is positioned, the second cuboid is positioned by placing its origin in each of the three available vertices of the largest cuboid. For each available vertex, the second cuboid is rotated in all possible positions, imposing one face of the second cuboid to overlap one face of the first cuboid. Each of the arrangements thus generated comprises the available vertices of both cuboids, except for the vertex of the first cuboid in which the origin of the second cuboid is placed. For each of these arrangements, the third cuboid is then positioned, by placing its origin in each of the available vertices of the primary cuboids already positioned and by rotating it in all possible positions. The process is thus repeated until all the mutual arrangements of the primary cuboids are obtained.

Preferably, the combinations of cuboids are carried out in increasing order of partial containment volume. In other words, from the third primary cuboid to be positioned onwards, the combinations of cuboids are calculated starting from the arrangement of the previous primary cuboids having the lowest partial containment volume among the possible arrangements of the primary cuboids already considered. In some embodiments, it is envisaged defining exceptions to this rule, for example, it may be possible to impose that an item $a_{ij}$ is positioned as the last one, or not to be surmounted by a number of items greater than a threshold number. This allows preventing structurally delicate items from being compromised or damaged by the weight of other items.

When all possible arrangements that comprise all the primary cuboids of the order $o_i$ (output branch Y of decision step 1033), for each of the obtained arrangements are generated, the 3D algorithm calculates and stores (step 1035) the measurements $X_i$, $Y_i$ and $Z_i$ as well as the volume $X_i*Y_i*Z_i$ of the secondary cuboid circumscribed to the arrangement. All data relative to each arrangement and to the relative secondary cuboid are saved in a temporary list in which the secondary cuboids are sorted by increasing volume, from the one with the smallest volume to the one with the largest volume.

Preferably the temporary list contains a limited number of arrangements, starting from the one with smallest volume. In fact, the number of possible provisions grows very quickly as the number of items $a_{ij}$ in the order $o_i$ grows and maintaining the complete list can be extremely computationally burdensome, as well as useless from a practical point of view. For example, the temporary list may be limited to a maximum of 100 arrangements. If the order $o_i$ provides for a greater number of possible arrangements, the data of only 100 thereof with the smallest volume will be stored.

In one embodiment, it may be defined a secondary offset value corresponding to a gap to be left between the secondary cuboid and the walls of the box to allow the insertion of filling and protection material during the packaging procedure, in a manner similar to that described above.

Figure 4:
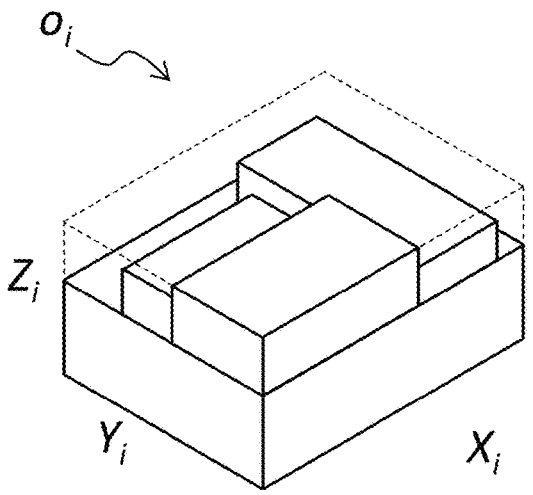
FIG. 4 schematically represents a compact arrangement of the items of FIG. 3.
Figure 5:
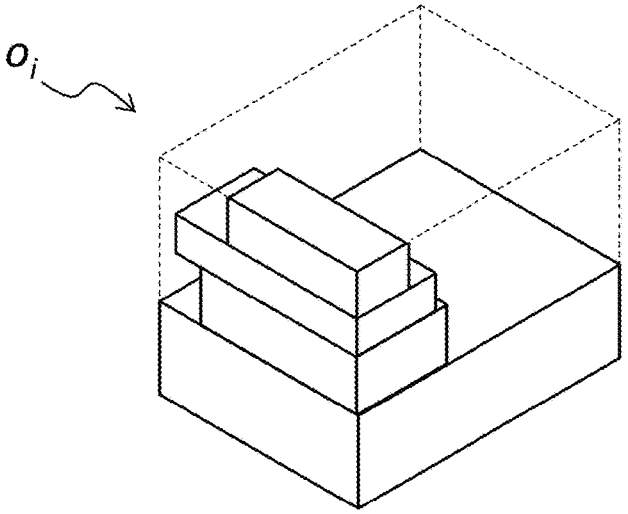
FIG. 5 schematically represents a non-compact arrangement of the items of FIG. 3.

FIGS. 4 and 5 respectively represent two different arrangements of the items of FIG. 3. As can be noted even at an intuitive level, the arrangement of FIG. 4 is more compact than that of FIG. 5.

In accordance with some embodiments, the 3D algorithm 1020 selects (step 1037) the most compact arrangement among those calculated as the one that generated the secondary cuboid of minimum volume, i.e. the first of the temporary list. In this case, the first secondary cuboid of the list is the one that will be considered suitable and will be initiated (step 1039) to the subsequent steps of the method 100; in particular, of this cuboid it will be first defined the blank $\mathbf{64}_i$ to manufacture the box $\mathbf{66}_i$ intended to contain the order $o_i$.

Alternatively, the 3D algorithm 1020 may be configured for using a different criterion of selection of the arrangement. For example, in an alternative embodiment, the 3D algorithm 1020 is configured for selecting the arrangement associated with the secondary cuboid having the smallest total surface among the calculated secondary cuboids so as to minimize the consumption of packaging material.

Preferably the 3D algorithm 1020 can carry out some checks on the measurements $X_i$, $Y_i$ and $Z_i$ of the secondary cuboid and of the relative blank $\mathbf{64}_i$. In particular, a check can be aimed at verifying that the measurements $X_i$, $Y_i$ and $Z_i$ are comprised within the dimensional ranges that can be correctly managed by the plant 50. In fact, each of the stations of the plant 50 (such as for example the cutting station 62 or the pre-assembly station 68 that will be described later) can only manage the blanks 64 comprised within certain dimensional limits.

If the 3D algorithm 1020 verifies that the blank $\mathbf{64}_i$ has one or more sizes lower than the minimum limit, it may intervene in different ways, depending on the embodiments of the invention. For example, the 3D algorithm 1020 may force the increase of the too small sizes until reaching the respective minimums so that the blank $\mathbf{64}_i$ can be managed. Optionally, in this case it is possible that the 3D algorithm 1020 also signals the opportunity of introducing filling and protection material to fill the empty gap inside the forcibly enlarged box. Alternatively, the 3D algorithm 1020 may interrupt the procedure of manufacture of the blank $\mathbf{64}_i$ and divert the order $o_i$ onto another line where it may be managed differently, for example manually. Finally, alternatively or in addition, the 3D algorithm 1020 may signal the problem to an operator.

With regard to the maximum dimensional limits, it is preferable that a preliminary check be carried out a priori on all the items managed by the storage. If a single item exceeds the maximum sizes that can be managed by the plant, it is clear that this item will have to be managed in a special way. Different is the case, subject of the check carried out here by the 3D algorithm 1020, in which the excessive sizes of the blank $\mathbf{64}_i$ derive from the arrangement of the many items $a_{ij}$ that constitute the order $o_i$. In this case, if the 3D algorithm 1020 verifies that the blank $\mathbf{64}_i$ has one or more sizes exceeding the maximum limit, then it may intervene in different ways, depending on the embodiments of the invention. For example, the 3D algorithm 1020 may force the separation of the order $o_i$ into two sub-orders, each of which may be managed exactly as a single order. Alternatively, the 3D algorithm 1020 may interrupt the procedure of manufacture of the blank $\mathbf{64}_i$ and divert the order $o_i$ onto another line where it may be managed differently, for example manually. Finally, alternatively or in addition, the 3D algorithm 1020 may signal the problem to an operator.

In accordance with other embodiments, the 3D algorithm 1020 carries out a further check on the proportions between the measurements $X_i$, $Y_i$ and $Z_i$ of the secondary cuboid of minimum volume (indicated by the dashed steps between step 1037 and step 1039). The purpose of this check is to prevent boxes 66 having extreme ratios among the measurements from being assembled. In fact, these boxes 66 may be weak and therefore, in the steps following this method (typically handling and shipping), they risk exposing the respective items to possible damages.

Wanting to avoid this eventuality, being a limit proportion P defined, the 3D algorithm 1020 verifies (decision step 1041) whether the first secondary cuboid of the temporary list (i.e. the one of minimum volume) satisfies the condition $(1/P)<R<P$, wherein R is from time to time the ratio between two of the three measurements of the cuboid, i.e. R subsequently assumes the values $X_i/Y_i$, $Y_i/Z_i$ and $X_i/Z_i$.

If the first secondary cuboid in the list satisfies the condition on the limit proportion P (output branch Y of the decision step 1041), then that cuboid is considered suitable and will be considered in the subsequent steps of the method, i.e. the method proceeds to step 1039. Otherwise (output branch N of the decision step 1041), the first secondary cuboid is considered unsuitable and the 3D algorithm selects (step 1043) the second secondary cuboid of the temporary list, i.e. the one having the volume immediately greater than the minimum and returns to the verification step 1041. In other words, in this case the 3D algorithm 1020 proceeds iteratively until it finds the suitable secondary cuboid, i.e. the cuboid of minimum volume among those satisfying the condition on the limit proportion P. By way of example, the limit proportion P can be set equal to 20.

In an alternative embodiment, in case it is not possible to identify a secondary cuboid that satisfies the condition on the limit proportion P, the 3D algorithm envisages decreasing the value of the limit proportion P and repeating steps 1041-1043, iteratively, until identifying a suitable secondary cuboid. By way of example, the value of the limit proportion P can be decreased by 10% on each attempt.

Once the suitable secondary cuboid is identified, the relative arrangement is stored in combination with the order $o_i$, for the subsequent step of arranging the items $a_{ij}$ in the box $\mathbf{66}_i$. To lighten the memory of the system, it is now possible to discard the temporary list with all the less compact arrangements and with the relative unsuitable secondary cuboids that will no longer be used.

Once an order $o_i$ has been considered, that is, once the most compact arrangement of the relative items $a_{ij}$ has been identified and stored, the order $o_i$ is arranged in a standby storage 56 in its container $\mathbf{72}_i$. The standby storage 56 is a non-sequential automated access storage, in which the containers 72 can be entered and removed in an automated manner and in any order.

The method then provides for defining the blanks 64 representing the plane development of the boxes 66 which define respectively an inner volume equal to each suitable secondary cuboid, identified in the previous steps.

Figure 6:
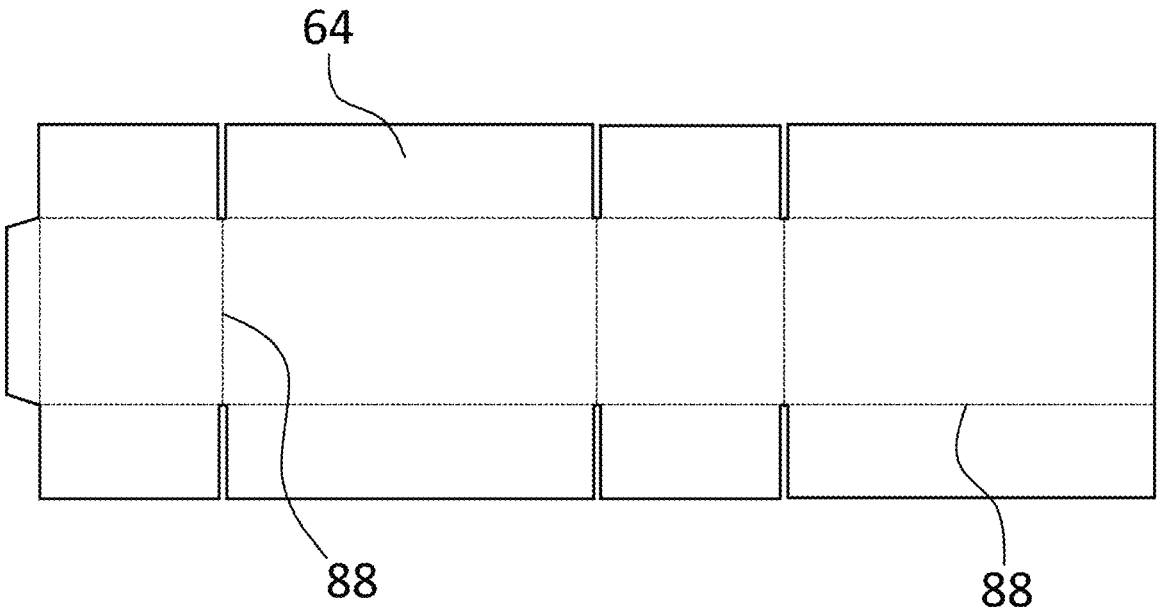
FIG. 6 schematically represents the blank RSC of a box.
Figure 7:
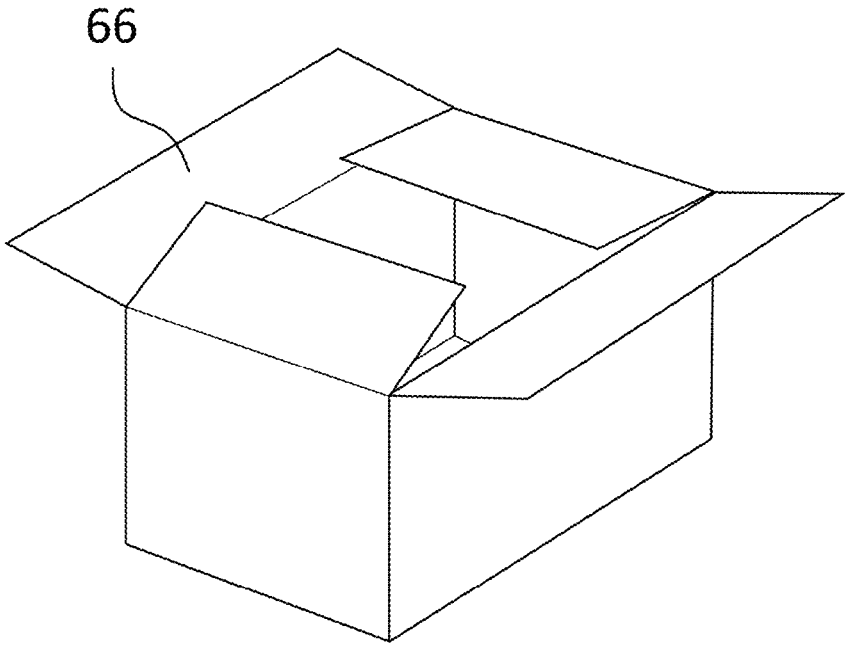
FIG. 7 schematically represents the box assembled starting from the blank of FIG. 6.

Preferably the blanks 64 are defined based on the well-known RSC standard (Regular Slotted Container) shown by way of example in FIG. 6. In the boxes 66 obtained from blanks 64 RSC, the side walls are obtained by subsequent folds of a single continuous element, at one end of which a fin (or "manufacturer's edge") is provided for gluing with the opposite end. The upper and lower ends of the box 66 are obtained by closure flaps which constitute extensions of the side walls. All the closure flaps have the same length, from the fold to the edge. Thus the closure flaps that extend from the long sides meet in the middle, while the closure flaps that extend from the short sides do not meet (see for example FIG. 7).

Once defined, the blank 64*i* is added to a standby list. The method, therefore, envisages having in the standby storage 56 a plurality of orders, in the respective containers 72, and having the corresponding blanks 64 in a standby list, maintaining a bi-unique connection between the orders o and the blanks 64.

The method then envisages providing a sheet 60 of packaging material of predefined sizes. It is preferable that the packaging material is easy to cut and to fold to simplify the manufacture of the secondary packaging, that it is semi-rigid to be able to protect its content and that it is economical. For these reasons, the packaging material is preferably corrugated cardboard, of the type commonly used to manufacture traditional secondary packagings. Although other packaging materials may be used in the method of the disclosure, for simplicity of presentation reference will be made hereinafter to cardboard, in particular to corrugated raw cardboard.

This type of cardboard can be made available in different shapes. One possible shape is that of a continuous roll from which the cardboard is progressively unwound. In this case the cardboard sheet 60 has a fixed size (called width) while the other size (the length) is a priori indefinite. For the purposes of the present method it is also preferable to establish a maximum length of the sheet 60, for example based on the sizes of the cutting station 62. In this way the sizes of sheet 60 are predefined.

In accordance with other embodiments, the cardboard is provided in the form called fanfold or also continuous form, consisting of a single structurally continuous element folded as an accordion or like a Z. Also in this case, the sheet 60 has a fixed width, while the distance between two subsequent predefined folds is preferably considered as the length. In this way, which is the one mostly widespread to manage the fanfold cardboard, the sizes of the sheet 60 are predefined.

However, it is possible, in case of specific needs, to consider longer or shorter lengths of the sheet. As the skilled person can well understand, the choice to adopt a length of the sheet different from the distance between the predefined folds generally has the effect of obtaining one or more blanks 64 crossed by a predefined fold. This occurrence does not entail great drawbacks since, as mentioned above, the cardboard is structurally continuous and the relative weakness constituted by the predefined fold is usually compensated for by the shape resistance of the box 66 once it is correctly assembled. Thus, for the cardboard sheet 60 a length different from the distance between the predefined folds can also be established (for example based on the sizes of the cutting station 62) but in any case, the sizes of the sheet 60 are predefined.

In accordance with other embodiments, the cardboard is provided in stacks of single pre-cut sheets 60. In this case, the sizes of the sheet 60 are predefined.

Regardless of how the packaging material is supplied (roll, fanfold or single sheets), in some cases it is preferable that the considered width available for positioning the blanks 64 is slightly smaller than the actual width. In cases where the steps of managing and cutting the blanks 64 (blocks 107 and 109) are carried out in an automated manner, it is preferable to keep intact, and therefore unavailable for cutting, two strips 74 at the ends of the sheet 60. The feeding members 58 can thus usefully act on such strips 74 to supply the packaging material to the cutting station 62, for example wheels suitable for advancing the sheet 60 by friction.

Once a certain amount of blanks 64 has been accumulated in the standby list, the method envisages optimizing the arrangement of the blanks 64 in the sheet 60. In order to efficiently carry out this step, two-dimensional optimization algorithms, called nesting, are available in the sector, which allow a very evolved optimization. Below the two-dimensional optimization algorithm is called in brief 2D algorithm.

The 2D algorithm will thus choose from the plurality of blanks 64 in the standby list, the subset of blanks 64 that best fill the sheet 60, thus minimizing rejects and the waste of material. The subset of blanks 64 is then traced on the sheet 60, for the subsequent cutting step, and removed from the standby list.

Figure 8:
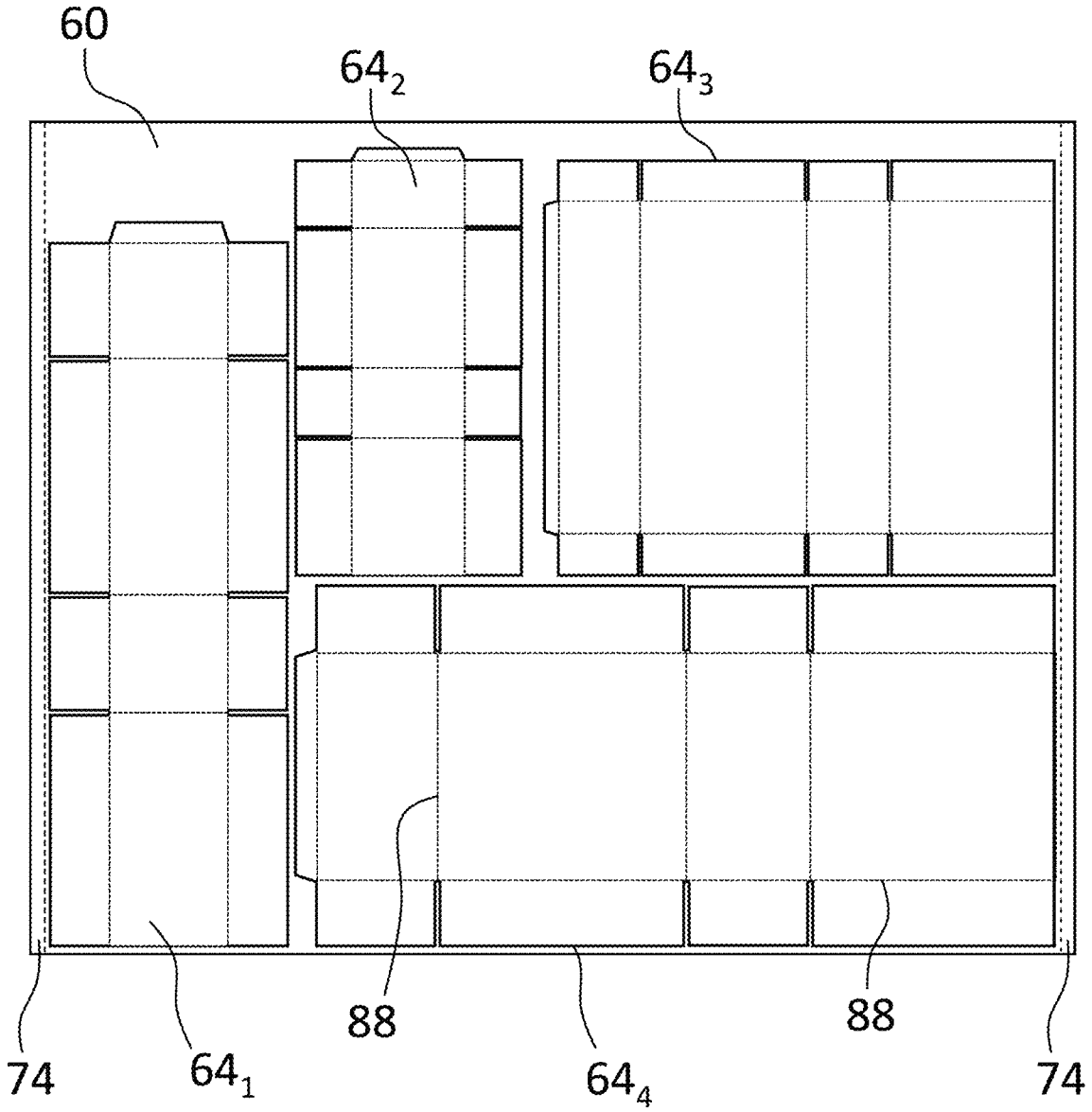
FIG. 8 schematically represents a plurality of blanks RSC arranged in a sheet with predefined sizes.
Figure 9:
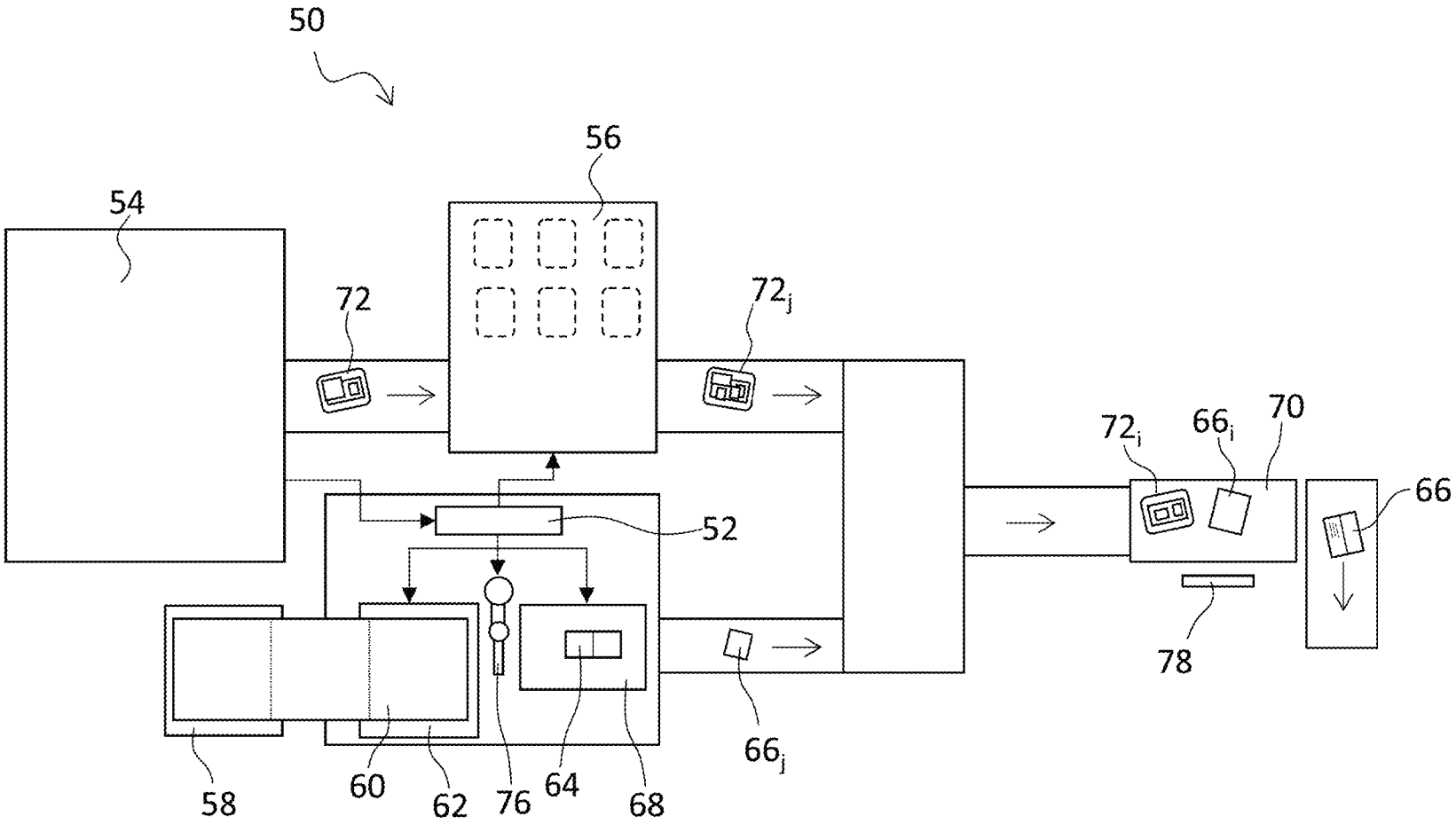
FIG. 9 schematically represents a plan view of a plant in accordance with the disclosure.

Preferably the result of the 2D algorithm is a map of the arrangement of the blanks 64 on the sheet 60 (see FIG. 8).

As the skilled person can well understand, the criterion of the pure optimization of the 2D algorithm does not guarantee any limit to the permanence of a specific blank $\mathbf{64}_i$ in the standby list. In other words, although it is statistically unlikely, it may happen that a specific blank $\mathbf{64}_i$ is never taken from the list and remains there for an indefinite time. To avoid this kind of occurrence, which can have unpleasant consequences for the order $o_i$ to which it is connected, a specific constraint can be introduced to the 2D algorithm. In other words, it is possible to force the 2D algorithm to introduce into the subset a late blank 64, i.e. that has remained on the standby list for a time longer than a predefined limit. The 2D algorithm will therefore start by positioning the late blank 64 and will then be free to position other blanks 64, chosen from the standby list with the sole aim of making the most of the sheet 60. This way of managing the late blanks 64 can occasionally lead to sub-optimal solutions but ensures that all orders are processed within a maximum time decided by the manager.

FIG. 8 schematically represents the map generated by the 2D algorithm, i.e. a sheet 60 within which four RSC 64 blanks have been arranged in order to minimize the waste of material. Note that the sheet 60 of FIG. 8 comprises two end strips 74 for automatic movement.

Preferably, a printing step may be interposed between the 2D optimization step (block 108) and the step of cutting the blanks 64 (block 109). The printing step may take place by means of a technique commonly used in the sector of the packagings, preferably a digital printing technique that allows the printing areas to be defined each time on each blank 64, based on the map generated by the 2D algorithm. For example, the printing step may take place by means of an inkjet printer, preferably thermal inkjet (thermal inkjet).

The print may be different for each blank 64*i* and may reproduce information useful for the subsequent steps, such as a unique identifier of the order $o_i$ for which the blank 64*i* has been defined (such as an alphanumeric string, barcode, QR code, or the like), information useful for shipping such as the name and the address of the recipient, a logo or a brand identifying the seller or the service manager, an advertising message, a message personalized for the recipient, etc.

The print may cover both sides of the sheet 60, as some information is preferably intended to appear outside the box 66 obtained from the blank 64 (e.g. the shipping address), while other information is preferably intended to appear inside the box 66 (e.g. a private message to the recipient).

Preferably, following the printing step, there is a step of overturning the sheet 60. The step of overturning the sheet 60 may be followed by a second printing step and/or by the step of cutting the blanks 64 (block 109). As the skilled person can well understand, the overturning of the sheet 60 necessarily requires a similar overturning of the map, generated by the 2D algorithm, on the basis of which the cutting step is carried out.

The method of the disclosure may advantageously comprise a creasing step, i.e. a step in which folding lead-ins (called creases 88) are provided which facilitate the subsequent folding operations of the blank 64. Preferably such a creasing step is carried out when the sheet 60 is still whole, between the 2D optimization step (block 108) and the step of cutting the blank 64 (block 109). Depending on the specific needs, the creasing step may be carried out before or after the printing steps and/or before or after the step of overturning the sheet 60.

Along the creases 88 the material of the sheet 60 is compressed so as to locally decrease the moment of inertia of the section and thus define a preferential fold line. For example, in the case where the sheet 60 is made of corrugated cardboard, along the creases 88 the two outer sheets are brought closer one another by flattening the waves of the intermediate sheet.

The creasing step can be carried out by means of a pressing element that follows the fold lines defined in the map generated by the 2D algorithm, thus obtaining the creases 88. For example, the creasing step can be carried out using a Cartesian plotter that uses a pressing wheel as the end effector.

In FIGS. 6 and 8 the dashed lines comprised within the blanks 64 schematically represent the creases 88. In each blank 64, in accordance with the RSC type, a total of six creases 88 are provided: two creases 88 (generally longer, parallel to each other, horizontal in FIG. 6) define the fold lines between the side walls of the box 66 and the closure flaps, and another four creases 88 (generally shorter, perpendicular to the first two, vertical in FIG. 6) define the fold lines between the contiguous side walls and between an end side wall and the small gluing fin.

The step (block 109) of cutting the blanks 64 in the sheet 60 may be carried out in different ways, preferably by using numerically controlled machines. In accordance with some embodiments, the cut may take place mechanically, by means of a blade or a numerically controlled milling cutter. Preferably, the cut is carried out by means of a Cartesian plotter using a blade, for example an oscillating blade, as the end effector. Such a solution is preferable in some embodiments for simplicity and relatively low cost. In accordance with other embodiments, the cut may be carried out by a numerically controlled laser, either Cartesian or scanning one. The use of the laser is preferable in some embodiments for a greater reliability and reduced maintenance requirements.

Preferably the same Cartesian plotter can carry out the creasing and cutting steps, simply by adopting two different end effectors: the creasing wheel and the cutting blade.

In addition, by means of the laser it is also possible to proceed, by adopting a lower power, to perform creases, folding lead-ins that facilitate the subsequent folding operations, pre-cut lines that subsequently allow the box 66 to be opened along predefined lines, and/or markings of the blank 64 that report, for example, useful information for the subsequent steps. For example, with the laser it is possible to mark on the blank $\mathbf{64}_i$ a unique identifier of the respective order $o_i$ (for example in the form of an alphanumeric string, barcode, QR code or the like), information useful for shipping such as the name and the address of the recipient, a brand identifying the seller or the service manager, etc.

In the event that the laser must act on both sides of the blank 64, it is possible to provide a station configured for overturning the blank 64 or to arrange two different laser devices, placed on the two opposite sides of the blank 64.

Once the blanks 64 have been cut, the method envisages taking them one by one and assembling with each one the relative box 66. The step (block 111) of taking a single blank $\mathbf{64}_i$ is preferably carried out automatically, for example by means of a robotic arm. A SCARA (Selective Compliance Assembly Robot Arm) robot equipped with one or more suction cups as an end effector is particularly suitable for this type of operations. Other robots suitable for carrying out the step (block 111) of taking each single blank $\mathbf{64}_i$ are, for example, an anthropomorphic robotic arm or a Cartesian portal robot. Once taken from the cutting station 62, the cut blank $\mathbf{64}_i$ is fed to a pre-assembly station 68 of the box $\mathbf{66}_i$.

The step (block 112) of assembling the box 66 starting from the cut blank 64 may also be carried out in different ways. For example, it may be preferable to perform a pre-assembly step automatically, and then complete the assembly manually.

In the preferred case where the blank 64 is of the RSC type, the step of pre-assembling the box 66 envisages first folding the side wall comprising the fin inwards, and then folding the opposite side wall inwards, so that it covers the fin. It is then necessary to provide joining members, in a manner known per se, to join the fin to the opposite side wall. For example, the joining members may be glue, double-sided tape, metal staples, and the like.

This step of pre-assembly of the box 66 can be carried out automatically by means of a special station that performs the folding and joining actions (for example by gluing). Preferably this step can be carried out by means of an automatic station of pre-assembly of the box 66 of the type developed by the same Owner and described in the patent document entitled PRE-ASSEMBLY STATION FOR PACKAGINGS OF VARIABLE SIZES filed on the same date.

Said automatic pre-assembly station 68 is configured for receiving in input blanks 64 representing the plane development of at least two boxes 66 of different sizes and for releasing in output pre-assembled boxes. The pre-assembly station 68 comprises:

- a worktable having a width and a length, wherein the worktable is configured for receiving and supporting a blank 64 with a predetermined orientation;
- two folding elements 80, movable in the direction w of the width of the worktable; and
- pushing members 86 configured for pushing the shape 64 toward the folding elements 80 and beyond, in the direction l of the length of the worktable.

Furthermore, each of the folding elements 80 comprises a helical screw surface 82 developing around a longitudinal axis b, parallel to the direction l.

The automatic pre-assembly station 68 described above allows to pre-assemble boxes 66 of variable sizes, through the steps of:

- providing a blank 64 representing the plane development of a box 66, wherein the blank 64 comprises two folding axes f;
- laying down the blank 64 on the worktable of the pre-assembly station 68 with a predetermined orientation;
- aligning the folding elements 80 of the pre-assembly station 68 with the folding axes f of the blank 64; and pushing the blank 64 toward the folding elements 80 and beyond.

Once the two side walls are joined, the pre-assembled box 66 is obtained. In this state the box 66 has the structural continuity of the side walls but is collapsed on itself and must be closed at the upper and lower ends. To conclude the assembly of the box 66 it is therefore necessary to space the side walls from each other, so that they are perpendicular two by two and it is necessary again to fold the closure flaps intended to constitute the bottom of the box 66. Also in this case, in a manner known per se, it is necessary to provide joining members such as glue, adhesive tape, double-sided tape, metal staples and the like.

In accordance with the method of the disclosure, this second part of the assembly of the box 66 is preferably carried out manually by one or more operators. Even more preferably, together with the single pre-assembled box $\mathbf{66}_i$, the operator also receives the container $\mathbf{72}_i$, taken from the standby storage 56 and containing the order of corresponding to that specific box $\mathbf{66}_i$. Preferably the same operator also receives instructions on how to arrange in the box $\mathbf{66}_i$ the items $a_{ij}$ of the order $o_i$ according to the most compact arrangement.

The manual execution of these operations allows to greatly simplify the plant 50, thus limiting the initial investment costs, but above all it allows to handle all types of items, including the fragile, perishable or potentially dangerous ones. In this way, the method is therefore very robust and uniform and does not require diversified handlings.

Once the assembly of the box $\mathbf{66}_i$ has been completed, the operator can proceed to arrange therein the items $a_{ij}$ of the order $o_i$ according to the most compact arrangement. For this purpose it is preferable that the packaging station 70 is suitable to provide instructions to the operator that allow him to faithfully reproduce the most compact arrangement previously identified through the 3D algorithm. For example, it is possible to generate and show on a monitor 78 a dynamic pattern or short video in which the various items $a_{ij}$ (identified based on the appearance, a special numbering, or otherwise) are virtually positioned in the volume defined by the box $\mathbf{66}_i$, in the correct sequence and with the correct orientation.

At this point it is possible to provide the box $\mathbf{66}_i$ for the subsequent steps that go beyond the method of the present disclosure, such as for example the addition of the shipping documents, the closure, the application of warnings for handling or indications such as the address of the recipient and so on.

The steps of the method following the step of cutting the blanks 64 in the sheet 60 (blocks 111 to 115), i.e.—in short—the steps of taking a cut blank 64 (block 111), assembling the relative box 66 (block 112), taking the corresponding order from the standby storage 56 (block 113), arranging the items in the box 66 according to the most compact arrangement (block 114) and providing the box 66 for the subsequent steps (block 115), must be repeated up to the end of the cut blanks 64 in the sheet 60. Once the cut blanks 64 are ended, the waste of packaging material can be discarded and a new sheet 60 (block 107) can be provided.

In the meantime, the previous steps of the method (blocks 101 to 106) will in turn have been repeated as described above, such that new blanks 64 have been defined and stored in the standby list and that respective orders have been placed in the standby storage 56.

Then the method can proceed, with a new step of two-dimensional optimization of other blanks 64 in the new sheet 60 (block 108), and with the subsequent steps.

Ultimately, the method of the disclosure may be repeated up to the end of the orders (block 118).

In accordance with a second aspect, the disclosure concerns a plant 50 for manufacturing a secondary packaging according to the BOD logic (Box On Demand). The plant 50 of the disclosure comprises:

- An electronic unit 52 comprising a memory module, an elaboration module, and control modules configured for providing instructions to the plant 50;
- A general storage 54 comprising a plurality of items;
- Handling members configured for, on the basis of the instructions provided by the electronic unit 52:
  - taking items from the general storage 54; and
  - grouping together the taken items so as to constitute a plurality of orders,
- A standby storage 56 configured for maintaining the orders in standby;
- Feeding members 58 configured for making available a sheet 60 of packaging material of predefined sizes, on the basis of the instructions provided by the electronic unit 52;
- A cutting station 62 configured for cutting out of the sheet 60 the blank 64 of a box 66 on the basis of the instructions provided by the electronic unit 52, wherein the blank 64 is defined by the electronic unit 52 in relation to a specific order;
- A pre-assembly station 68 configured for pre-assembling the box 66 starting from the cut blank 64;
- A packaging station 70;
- Movement members configured for making available to the packaging station 70 the pre-assembled box 66 together with the related order.

In Addition, the Electronic Unit 52 is Configured for:

- defining the blank 64 of the box 66 relative to each order $o_i$,
- adding each blank 64 to a standby list;
- optimizing the arrangement on the sheet 60 of at least some of the blanks 64 in the standby list; and
- deleting the cut blanks 64 from the standby list.

As the skilled person can well understand, the following description of the plant 50 refers, explicitly or even implicitly, to the above description of the method. The plant 50 described below is in fact configured for carrying out the steps of the method of the disclosure.

The general storage 54 and the handling members, as well as the standby storage 56 and the movement members are in themselves widely known in the logistics sector and therefore will not be described in detail. In particular, they are known in the field of automated storage and archive management. As the skilled person can well understand, both storages 54, 56 have non-sequential access, in which the objects can be entered and removed in an automated manner and in any order.

The general storage 54 is basically a large automated supermarket, configured for potentially containing all the items offered for sale by the manager, usually in a plurality of examples for each item. Otherwise, the standby storage 56 is smaller, configured for temporarily containing orders once they have been assembled, preferably contained in the respective containers 72.

Both the storages 54, 56, and the handling and movement members operate on a shared basis of unique identification of the objects, of the positions, of the containers 72, etc. Such unique identification exploits technologies based on automatic recognition, for example by optical codes (such as barcodes, QR codes or the like) or by short-range signals (such as RFID, NFC or the like).

The electronic unit 52 is configured for carrying out all the processing steps (blocks 101, 102, 103, 105, 106, 108 and 110), that is, in short: defining the primary cuboid circumscribed to each item $a_{ij}$; identifying the relative arrangement of the items $a_{ij}$ that is the most compact for each order $o_i$; detecting the sizes of the secondary cuboid circumscribed to the most compact arrangement; for each secondary cuboid defining the blank of the relative box; adding each blank to a standby list; optimizing the arrangement on the sheet 60 of some of the blanks in the standby list and deleting the cut blanks from the standby list. The electronic unit 52 is further configured for storing in an orderly manner all necessary information and, based on such processing and information, provide the instructions for controlling the plant 50 in executing the method.

Preferably the information acquired by the electronic unit 52, in addition to being temporarily saved for carrying out the method of the disclosure, can also be saved in a database for subsequent reference by the manager or the manufacturer of the plant or even, if provided for in the commercial agreement, to be sold to third parties.

In particular, the electronic unit 52 is configured for defining the primary cuboid circumscribed to each item $a_{ij}$ (block 101). More specifically, if the sizes of the item are already known, the electronic unit 52 is configured for retrieving them from the relative database, be it remote or local, and store them in combination with the specific item $a_{ij}$.

Otherwise, in case the sizes are not available, the electronic unit 52 is configured for detecting such sizes by a three-dimensional scan. In order to be able to best manage the case of items having unknown sizes, the plant 50 advantageously comprises a three-dimensional scanning device, known per se (not shown). Preferably such a three-dimensional scanning device is configured for operating continuously, for example while the item $a_{ij}$ of unknown sizes is being moved by the handling members, for example while sliding on a conveyor belt.

The electronic unit 52 is then configured for identifying, for each order $o_i$, the relative arrangement of the items $a_{ij}$ that is the most compact (block 102). For this purpose, the electronic unit 52 is preferably configured for adopting the three-dimensional optimization algorithm (or 3D algorithm) described above in relation to the method.

The electronic unit 52 is configured for detecting the sizes of the secondary cuboid circumscribed to the most compact arrangement identified (block 103) and for defining the blank 64 representing the plane development of the box 66 that defines an inner volume equal to said secondary cuboid (block 105). The electronic unit 52 is further configured for storing such information in combination with the specific order $o_i$. In particular, the electronic unit 52 manages the standby list of the blanks 64 (block 106) relative to the orders that are arranged in the standby storage 56.

The electronic unit 52 is configured for optimizing the arrangement on the sheet 60 of predefined sizes of at least some of the blanks 64 in the standby list, so as to minimize the waste of packaging material (block 108). For this purpose, the electronic unit 52 is preferably configured for adopting a two-dimensional optimization algorithm (or 2D algorithm) of known type.

Once the arrangement on the sheet of some of the blanks 64 has been optimized, the electronic unit 52 is configured for providing instructions to the feeding members 58 and to the cutting station 62.

The feeding members 58 comprise a reserve of packaging material, typically cardboard, which can take the form of a roll, fanfold or single sheets. Furthermore the feeding members 58 are configured for feeding to the cutting station 62 a single sheet 60 of the predefined measurements, on the basis of the instructions provided by the electronic unit 52. Preferably the feeding members 58 comprise wheels suitable for moving the sheet 60 acting by friction on two strips 74 reserved for this purpose at the ends of the sheet 60 itself. The cutting station 62 advantageously comprises a numerically controlled machine. In accordance with some embodiments, the cutting station 62 comprises a numerically controlled machine carrying out the cut in a mechanical way, for example by means of a blade or a milling cutter. The cutting station 62 may for example comprise a Cartesian plotter using as end effector a blade, preferably an oscillating blade. In accordance with other embodiments, the cutting station 62 comprises a numerically controlled machine carrying out the cut by means of a laser, for example Cartesian or scanning one.

Preferably the plant 50 further comprises a printing station (not shown) placed upstream of the cutting station 62.

The printing station may operate according to a technique commonly used in the sector of the packagings, preferably a digital printing technique that allows the printing areas to be defined each time on each blank 64, based on the map generated by the 2D algorithm. For example the printing station may comprise an inkjet printer, preferably thermal inkjet.

In accordance with some embodiments, the printing station may operate on both sides of the sheet 60. In fact, as already mentioned, some information is preferably intended to appear outside the box 66, while other information is preferably intended to appear inside the box 66.

Preferably the plant 50 further comprises an overturning station (not shown), configured for overturning the sheet 60, placed upstream of the cutting station 62.

The overturning station is configured for overturning the sheet 60 after a first printing step. Furthermore, the overturning station is configured for making the sheet 60 available again to the printing station (in case a second printing step is to be carried out on the opposite side) and/or for making the sheet 60 available to the cutting station 62.

Preferably the plant 50 further comprises a creasing station (not shown), advantageously placed in coincidence with or upstream of the cutting station 62. The creasing station is configured for moving a pressing element on the sheet 60, so as to compress the material of the sheet 60 along the fold lines defined in the map generated by the 2D algorithm. Pressing the pressing element on the fold lines generates the creases 88.

The creasing station may for example comprise a Cartesian plotter using as an end effector a pressing wheel.

Preferably the same Cartesian plotter can represent both the creasing station and the cutting station 62, simply by adopting two different end effectors: the creasing wheel and the cutting blade.

Preferably the plant 50 comprises a robotic arm 76 suitable for taking the cut blanks 64 from the cutting station 62 and feeding them to the pre-assembly station 68. The robotic arm 76 is preferably of the SCARA type, well known in the field of industrial handling. Other robots suitable for use in the plant 50 are, for example, an anthropomorphic robotic arm or a Cartesian portal robot. Preferably the robotic arm 76 comprises one or more suction cups as an end effector.

As already mentioned, the plant 50 comprises a pre-assembly station 68 configured for pre-assembling the box 66 starting from the cut blank 64. In accordance with what is described above in relation to the method, the pre-assembly station 68 is configured for obtaining the pre-assembled box 66 starting from the flat blank 64 (preferably of the RSC type). The pre-assembled box 66 has the structural continuity of the side walls but is open at the upper and lower ends and collapsed on itself.

To achieve this result, particularly starting from blanks RSC or similar, the pre-assembly station 68 must be capable of folding the side wall comprising the fin inwards, folding the opposite side wall inwards so that it covers the fin, and joining the side wall to the fin. Preferably the pre-assembly station 68 is automatic and can be of the type developed by the same Owner and described in the patent document entitled PRE-ASSEMBLY STATION FOR PACKAGINGS OF VARIABLE SIZES filed on the same date.

Said automatic pre-assembly station 68 is configured for receiving in input blanks 64 representing the plane development of at least two boxes 66 of different sizes and for releasing in output pre-assembled boxes. The pre-assembly station 68 comprises:

- a worktable having a width and a length, wherein the worktable is configured for receiving and supporting a blank 64 with a predetermined orientation;
- two folding elements 80, movable in the direction w of the width of the worktable; and
- pushing members 86 configured for pushing the blank 64 toward the folding elements 80 and beyond, in the direction l of the length of the worktable.
- wherein each of the folding elements 80 comprises a helical screw surface 82 developing around a longitudinal axis b, parallel to the direction l.

Preferably the folding elements 80 are briefly described below with particular reference to FIGS. 10 and 11. Each of such folding elements 80 comprises a first helical screw surface 82 (or helicoid) and a second substantially flat surface 84. The flat surface 84 lies parallel to the worktable (plane wl).

The two folding elements 80 of the pre-assembly station 68 have specular functions to each other, preferably they also have specular shapes to each other. FIG. 11 shows the left folding element 80. In such a left folding element 82, proceeding along l (thus from the inlet toward the outlet of the pre-assembly station 68) the helical screw surface 82 describes an arc of about 180°. At the proximal end of the folding element 80, the helical screw surface 82 lies to the left of the flat surface 84, substantially coplanar and parallel thereto. Proceeding in the direction l, the helical screw surface 82 shows a development that gradually rotates clockwise. At the distal end of the folding element 80, the helical screw surface 82 returns to be substantially parallel to the flat surface 84, although inverted by 180° and superimposed thereon.

The helical screw surface 82 may define a regular helicoid or may define an irregular helicoid. More in detail, the helical screw surface 82 defines, for each section operated in a plane perpendicular to the axis b, a straight segment inclined with respect to the flat surface 84. The angle comprised between the helical screw surface 82 and the flat surface 84 varies along the axis b; this variation can be appreciated in FIG. 11.

In accordance with some embodiments, such variation is uniform along the axis b; in other words, the angle comprised between the helical screw surface 82 and the flat surface 84 is a linear function of the position along the axis b. The helical screw surface 82 thus defines a regular helicoid.

In accordance with other embodiments, the angle variation is not uniform along the axis b; in other words, the angle comprised between the helical screw surface 82 and the flat surface 84 is a non-linear function of the position along the axis b. The helical screw surface 82 thus defines an irregular helicoid. For example, in some sections the angle variation may be slower and in other sections it may be faster. In other words, considering that the flat blanks 64 are pushed along the direction l at constant speed, the angular variation of the helical screw surface 82 may impose a gentler fold in some sections and a more abrupt fold in other sections.

Figure 10:
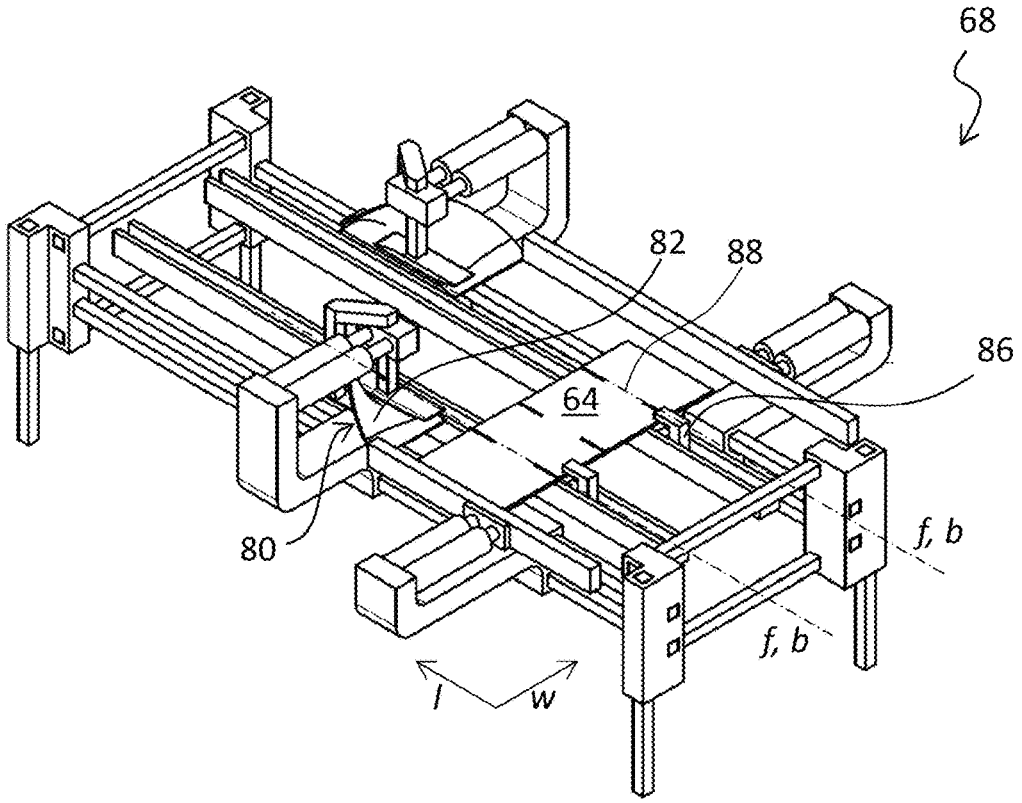
FIG. 10 schematically represents an axonometric view of a possible pre-assembly station of a plant in accordance with the disclosure.
Figure 11:
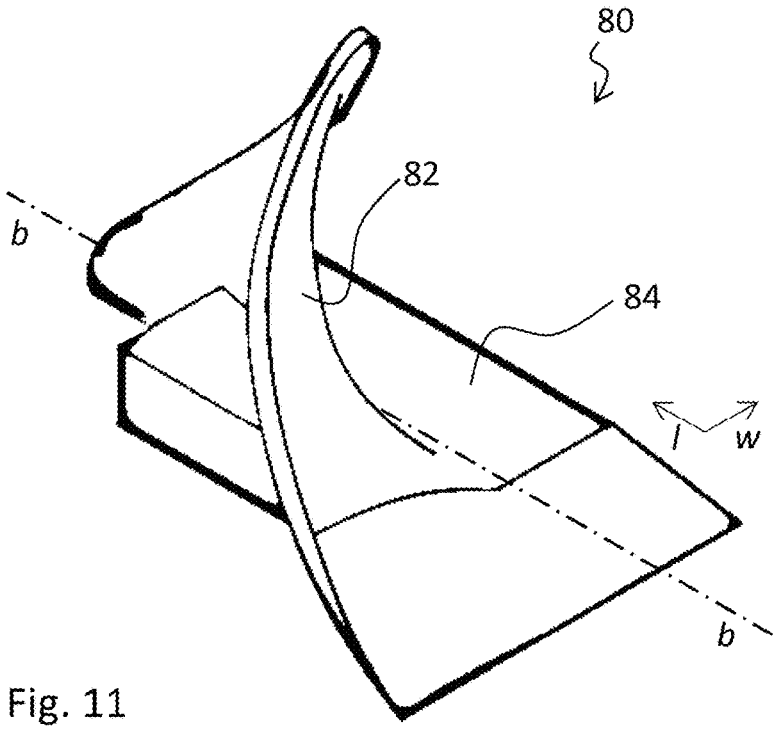
FIG. 11 schematically represents an axonometric view of a folding element of the pre-assembly station of FIG. 10.

In accordance with the embodiment shown in the attached FIGS. 10 and 11, the helical screw surfaces 82 of the folding elements 80 are continuous. In accordance with other embodiments (not shown), the helical screw surfaces 82 of the folding elements 80 may be discrete and/or discontinuous, obtained for example by juxtaposing linear guides.

In accordance with some embodiments, the surfaces 82 and 84 of the folding elements 80 comprise at least locally a coating suitable for facilitating the sliding of the material constituting the flat blanks 64. Preferably the coating may be made with a low friction coefficient material, such as for example bronze or Polytetrafluoroethylene (PTFE).

As the skilled person can well understand, the right folding element 80 is in all respects analogous to the left one just described, except for having a specular function to it and therefore preferably also having a specular shape to it.

Downstream of the pre-assembly station 68 on the one hand and of the standby storage 56 on the other, the plant 50 comprises a packaging station 70. In accordance with some embodiments, the packaging station 70 is fully manual and is manned by an operator. In this case the movement members are configured for making available to the operator, at the packaging station 70, the pre-assembled box 66 together with the related order, preferably contained in its container 72.

The operator must then manually proceed to conclude the assembly of the box 66 and stow the items of the order in the most compact arrangement. For this purpose, the packaging station 70 preferably comprises a device configured for providing the operator with indications relative to the most compact arrangement identified previously, for example through the 3D algorithm. For example, the packaging station 70 may comprise a monitor 78 configured for showing a dynamic diagram or a short video generated by the electronic unit 52, in which the various items (identified based on the appearance, a special numbering, or otherwise) are virtually positioned in the volume defined by the box 66, in the correct sequence and with the correct orientation.

The presence of the operator, in addition to clearly simplifying the packaging station 70, also makes it possible to manage the fragile, perishable or potentially dangerous items that cannot be handled automatically.

In accordance with other embodiments, the packaging station 70 has a first automated substation and a second manual substation manned by an operator. In the first substation, the assembly of the box 66 is completed in an automated manner, by folding the lower closure flaps that constitute the bottom of the box 66. In the second substation, the items of the relative order are manually introduced into the box 66. Also in this case it is preferable to arrange a device configured for providing the operator with indications relative to the most compact arrangement identified previously, for example through the 3D algorithm.

Also in this case the presence of the operator makes it possible to manage the fragile, perishable or potentially dangerous items, while the presence of the first automated substation allows to lighten the operator's workload and to obtain higher processing speeds.

In accordance with still other embodiments, the packaging station 70 is fully automated. Both the completion of the assembly of the box 66 and the introduction of the items into the box 66 are carried out automatically. This allows for higher processing speeds to be obtained.

Downstream of the packaging station 70, the plant 50 preferably comprises other movement members configured for making the full boxes 66 available for the subsequent steps.

In light of the above, the skilled person can well understand that the disclosure overcomes the drawbacks highlighted in relation to the prior art.

In particular, the present disclosure makes available a method and a plant for manufacturing a secondary packaging according to the BOD logic, which can handle all types of items, including the fragile, perishable or potentially dangerous ones.

Furthermore, the present disclosure makes available a method and a plant for manufacturing a secondary packaging according to the BOD logic, particularly efficient in terms of volume of the boxes produced and of consumption of packaging material.

Moreover, the present disclosure makes available a method and a plant for manufacturing a secondary packaging according to the BOD logic, which are very efficient in terms of cost/performance ratio.

Finally, the present disclosure makes available a method and a plant for manufacturing a secondary packaging according to the BOD logic, which, together with the advantages introduced, maintain the main functionalities of the prior art.

In conclusion, all the details can be replaced by other technically equivalent elements; the characteristics described in relation to a specific embodiment can also be used in the other embodiments; the materials used, as well as the contingent shapes and sizes, can be any according to the specific implementation needs without leaving the scope of protection of the following claims.

The invention claimed is:

1. Method for manufacturing a secondary packaging according to a Box On Demand logic, comprising the steps of:

providing a plurality N of orders o, each order $o_i$ comprising a plurality of items aij;

for each item aij of each order $o_i$, defining a primary cuboid circumscribed to the item aij;

for each order $o_i$, identifying a relative arrangement of the items aij that is the most compact;

for each order $o_i$, detecting sizes of a secondary cuboid circumscribed to the most compact arrangement;

arranging each order $o_i$ in a standby storage;

for each secondary cuboid defining a blank representing the plane development of a box which defines an inner volume equal to the secondary cuboid;

adding each blank in a standby list;

providing a sheet of packaging material of predefined sizes;

optimizing the arrangement on the sheet of at least some of the blanks in the standby list, so as to minimize waste of packaging material;

cutting blanks from the sheet;

deleting the blanks that have been cut from the standby list;

taking one of the blanks that have been cut from the sheet;

assembling the box with the blank that have been taken;

taking from the standby storage the order $o_i$ corresponding to the box that have been assembled;

arranging the items aij in the box according to the most compact arrangement;

providing the box for the subsequent steps;

repeating the steps of: taking one of the blanks, assembling the box, taking the corresponding order, arranging the items in the box, providing the box for the subsequent steps, up to the end of the blanks that have been cut from the sheet;

discarding waste of packaging material; and repeating the method up to the end of the orders.

2. Method according to claim 1, wherein the step of identifying for each order $o_i$ the relative arrangement of the items aij that is the most compact is carried out by means of a recursive optimization algorithm considering all the possible relative arrangements of the items aij, modifying step by step the positioning of each primary cuboid with respect to the other primary cuboids, calculating the sizes of all the secondary cuboids and selecting the most compact arrangement.

3. Method according to claim 2, wherein the recursive optimization algorithm implements the steps of:

defining each item aij by means of the respective primary cuboid having three measurements: xj, yj and zj, for each primary cuboid, identifying the measurements xj, yj and zj starting from a point called origin [0; 0; 0] which is positioned in a vertex of the cuboid, in each primary cuboid, identifying three available vertices, corresponding to the vertices in the positions [x]; 0; 0], [0; yj; 0] and [0; 0; zj] with respect to the origin, during the positioning step, arranging the origin of a new primary cuboid so as to coincide with an available vertex of one of the primary cuboids already positioned, and when the origin of a primary cuboid is positioned on an available vertex, discarding the cuboid from a list of primary cuboids to be arranged such that said primary cuboid is no more available for the subsequent positionings.

4. Method according to claim 2, wherein the optimization algorithm further envisages carrying out the steps of:

storing the volume and the sizes of each calculated secondary cuboid, verifying whether the secondary cuboid corresponding to the most compact arrangement of the items has a shape ratio between at least two sizes comprised in a tolerance range, in the positive, using said secondary cuboid, or in the negative, disregarding said secondary cuboid and selecting a further cuboid associated to the most compact arrangement once excluded the arrangement associated to the disregarded secondary cuboid and repeating the preceding step of verifying the secondary cuboid.

5. Method according to claim 2, wherein the optimization algorithm further carries out the step of adding an offset value to at least one of the sizes of at least one of the items to be arranged, said offset value corresponding to a gap necessary for placing a protection material for protecting the item, during the filling of the packaging.

6. Method according to claim 1, further comprising a step of printing and/or a step of creasing between the step of optimizing and the step of cutting the blanks.

7. Plant for manufacturing a secondary packaging according to Box On Demand logic, comprising:

an electronic unit comprising a memory module, an elaboration module, and control modules configured for providing instructions to the plant;

a general storage comprising a plurality of items a;

handling-members configured for, on the basis of the instructions provided by the electronic unit:

taking items a from the general storage; and grouping together the taken items a so as to constitute a plurality of orders o, a standby storage configured for maintaining the orders o in standby;

feeding members configured for making available a sheet of packaging material of predefined sizes, on the basis of the instructions provided by the electronic unit;

wherein the electronic unit is further configured for: defining a blank of a box relative to each order $o_i$, adding each blank to a standby list; optimizing arrangement on the sheet of some of the blanks in the standby list; and deleting the blanks that have been cut from the standby list;

and wherein the plant further comprises:

a cutting station configured for cutting out of the sheet the blank of a box on the basis of the instructions provided by the electronic unit, wherein the blank is defined by the electronic unit in relation to a specific order oi;

a pre-assembly station configured for pre-assembling the box starting from the cut blank;

a packaging station; and movement members configured for, on the basis of the instructions provided by the electronic unit, making available to the packaging station the pre-assembled box together with the related order oi.

8. Plant according to claim 7, wherein the electronic unit is further configured for: defining a primary cuboid circumscribed to each item aij; identifying the relative arrangement of the items aij that is the most compact for each order oi; detecting sizes of a secondary cuboid circumscribed to the most compact arrangement; for each secondary cuboid defining the blank of the relative box.

9. Plant according to claim 7, further comprising a printing station placed between the feeding of the sheet of packaging material and the cutting station.

10. Plant according to claim 7, further comprising a station for overturning the sheet.

11. Plant according to claim 7, further comprising a three-dimensional scanning device, configured for detecting the sizes of an item aij.

12. Plant according to claim 7, wherein the cutting station comprises a numerical control machine carrying out the cut by means of a laser.

13. Plant according to claim 7, wherein the cutting station comprises a numerical control machine carrying out the cutting by means of a blade.

14. Plant according to claim 7, further comprising a robotic arm suitable for taking the cut blanks from the cutting station and for feeding them to the pre-assembly station.

15. Plant according to claim 7, wherein the pre-assembly station comprises:

a worktable having a width and a length, wherein the worktable is configured for receiving and supporting a blank with a predetermined orientation;

two folding elements, movable in the direction w of the width of the worktable; and pushing members configured for pushing the blank toward the folding elements and beyond, in the direction l of the length of the worktable;

wherein each of the folding elements comprises a helical screw surface developing around a longitudinal axis b, parallel to the direction l.

* * * * *